US010102817B2

(12) United States Patent
Onishi et al.

(10) Patent No.: US 10,102,817 B2
(45) **Date of Patent: *Oct. 16, 2018**

(54) DISPLAY DEVICE AND DRIVING METHOD THEREOF

(71) Applicant: Panasonic Liquid Crystal Display Co., Ltd., Hyogo (JP)

(72) Inventors: Toshiki Onishi, Osaka (JP); Iwane Ichiyama, Osaka (JP); Tatsuhiro Inuzuka, Kanagawa (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 160 days.

This patent is subject to a terminal disclaimer.

(21) Appl. No.: 15/261,000

(22) Filed: Sep. 9, 2016

(65) Prior Publication Data

US 2016/0379583 A1 Dec. 29, 2016

Related U.S. Application Data

(63) Continuation of application No. PCT/JP2014/001385, filed on Mar. 11, 2014.

(51) Int. Cl.

| | |
|---|---|
| ***G09G 3/36*** | (2006.01) |
| ***G09G 3/20*** | (2006.01) |
| ***G09G 5/00*** | (2006.01) |

(52) U.S. Cl.

CPC ..... *G09G 3/3648* (2013.01); *G09G 3/20* (2013.01); *G09G 3/2092* (2013.01);

(Continued)

(58) Field of Classification Search

None

See application file for complete search history.

(56) References Cited

U.S. PATENT DOCUMENTS

2008/0278415 A1 11/2008 Itakura et al.
2012/0212521 A1 8/2012 Yamauchi et al.

(Continued)

FOREIGN PATENT DOCUMENTS

JP 2008-70783 3/2008
JP 2008-76611 4/2008

(Continued)

OTHER PUBLICATIONS

International Search Report dated May 27, 2014 in International (PCT) Application No. PCT/JP2014/001385.

*Primary Examiner* — Joseph Haley
*Assistant Examiner* — Emily Frank
(74) *Attorney, Agent, or Firm* — Wenderoth, Lind & Ponack, L.L.P.

(57) ABSTRACT

A display device includes a processor including a first display mode in which the processor displays the image on the display screen from an internal image data after the processor receives a first control signal, and a second display mode in which the processor displays the image on the display screen from the image data received by the processor after the processor receives a second control signal. A luminance adjuster adjusts a display luminance based on the internal image data corresponding to a final frame immediately before switching from the first display mode to the second display mode to a display luminance higher than a display luminance of the internal image data of another frame in the first display mode. In the final frame, the image is displayed based on the internal image data in which the display luminance is adjusted by the luminance adjuster.

12 Claims, 16 Drawing Sheets

(52) U.S. Cl.
CPC ..... *G09G 3/3618* (2013.01); *G09G 5/003* (2013.01); *G09G 2310/061* (2013.01); *G09G 2310/08* (2013.01); *G09G 2320/0247* (2013.01); *G09G 2320/0261* (2013.01); *G09G 2320/0276* (2013.01); *G09G 2320/064* (2013.01); *G09G 2320/10* (2013.01); *G09G 2320/103* (2013.01); *G09G 2340/0435* (2013.01); *G09G 2360/18* (2013.01)

(56) References Cited

U.S. PATENT DOCUMENTS

| | | | | |
|---|---|---|---|---|
| 2012/0218246 | A1 | 8/2012 | Ueda et al. | |
| 2013/0235014 | A1 | 9/2013 | Lee et al. | |
| 2016/0117995 | A1* | 4/2016 | Lee ..... | G09G 3/20 345/691 |
| 2016/0379584 | A1* | 12/2016 | Onishi ..... | G09G 3/3648 345/691 |

FOREIGN PATENT DOCUMENTS

| | | |
|---|---|---|
| JP | 2008-281928 | 11/2008 |
| JP | 2011-170386 | 9/2011 |
| JP | 5-132763 | 11/2012 |
| JP | 2013-190777 | 9/2013 |
| WO | 2009/125600 | 10/2009 |
| WO | 2011/052472 | 5/2011 |

* cited by examiner

| INPUT GRAYSCALE | OUTPUT GRAYSCALE |
|---|---|
| 0 | 0 |
| 32 | 34 |
| 64 | 67 |
| 128 | 132 |
| 160 | 163 |
| 192 | 195 |
| 224 | 226 |
| 255 | 255 |

FIG. 7

| INPUT GRAYSCALE | OUTPUT GRAYSCALE |
|---|---|
| 0 | 0 |
| 32 | 38 |
| 64 | 71 |
| 128 | 140 |
| 160 | 167 |
| 192 | 199 |
| 224 | 230 |
| 255 | 255 |

FIG. 8

| INPUT GRAYSCALE | OUTPUT GRAYSCALE |
|---|---|
| 0 | 0 |
| 32 | 40 |
| 64 | 73 |
| 128 | 143 |
| 160 | 169 |
| 192 | 201 |
| 224 | 232 |
| 255 | 255 |

| INPUT GRAYSCALE | OUTPUT GRAYSCALE |
|---|---|
| 0 | 0 |
| 32 | 30 |
| 64 | 61 |
| 128 | 122 |
| 160 | 156 |
| 192 | 189 |
| 224 | 222 |
| 255 | 255 |

DISPLAY DEVICE AND DRIVING METHOD THEREOF

CROSS-REFERENCE TO RELATED APPLICATION

This application is a bypass continuation of international patent application PCT/JP2014/001385, filed: Mar. 11, 2014 designating the United States of America, the entire disclosure of which is incorporated herein by reference.

TECHNICAL FIELD

The present disclosure relates to a display device, particularly to a display device applied to a display system having a PSR (Panel Self Refresh) function.

BACKGROUND

The display system includes a system unit that receives a video signal output from an external signal source (host) and a display device that receives the video signal, output from the system unit, to display an image. The display device includes a display panel that displays the image, a drive circuit that drives the display panel, and a control circuit that controls the drive of the drive circuit. In recent years, a PSR technology is proposed as a technology of reducing power consumption of the whole display system (See Japanese unexamined published patent application No. 2013-190777).

In the PSR technology, in a case where image data (frame image data) in units of frames in the video signal output from the host is a still image, an output operation of frame image data from the system unit is stopped, and the display is performed using the frame image data stored in a storage unit of the control circuit. In the display system having the PSR function, the output operation from the system unit can be stopped while a still image is displayed, so that power consumption of the display system can be reduced as a whole.

However, in the display device applied to the display system, there is a problem in that display quality is degraded by a flicker. A principle of generation of the flicker will be described below. FIGS. 3 and 19 are views illustrating a principle of the generation of the flicker.

In the PSR technology, in order to reduce the power consumption, a drive frequency at which a still image is displayed is set lower than a drive frequency at which a moving image is displayed. While the system unit is in a stopped state, the control circuit outputs the frame image data from the storage unit in asynchronization with the system unit. Therefore, timing at which the frame image data in the video signal output from the host is switched from a still image to a moving image deviates from timing at which a frame period of the still image output from the storage unit is ended. When the deviation is generated, a vertical retrace period (blanking period BR1) is lengthened in the frame image data (the image data of a frame 3 in FIG. 3) indicating a still image immediately before the switching from a PSR mode to a normal mode. When the blanking period becomes longer than or equal to a predetermined period (for example, a blanking period BR0 in FIG. 3), in a frame (a frame 3 in FIG. 3) immediately before the PSR mode is switched to the normal mode, a potential (pixel potential) written in a pixel is lowered less than or equal to a predetermined value, and a display luminance is largely lowered (refer to FIG. 19). Then, in the frame (a frame E in FIG. 3) immediately after the switching from the PSR mode to the normal mode, a change in display luminance (display luminance difference) is increased, and recognized as the flicker by human's eyes.

SUMMARY

The present disclosure has been made in view of the above circumstances and an object of the present disclosure is to improve the display quality in the display device to which the PSR function is applied.

In one general aspect, the instant application describes a display device including a processor that performs processing on each frame of image data that includes plural frames, the display device displaying an image on a display screen based on the image data processed by the processor, wherein the processor receives the image data, a first control signal indicating a command to stop output of the image data, and a second control signal indicating a command to perform the output of the image data, a memory in which the image data received immediately before stop of transmission of the image data is stored as internal image data, and a luminance adjuster that adjusts a display luminance based on the internal image data transferred from the memory. The processor includes a first display mode in which the processor displays the image on the display screen from the internal image data after the processor receives the first control signal, and a second display mode in which the processor displays the image on the display screen from the image data received by the processor after the processor receives the second control signal. The luminance adjuster adjusts a display luminance based on the internal image data corresponding to a final frame immediately before switching from the first display mode to the second display mode to a display luminance higher than a display luminance of the internal image data of another frame in the first display mode, and in the final frame immediately before switching from the first display mode to the second display mode, the image is displayed on the display screen based on the internal image data in which the display luminance is adjusted by the luminance adjuster.

The above general aspect may include one or more of the following features. The display device may further include a calculator that calculates a blanking period from a writing end time point of the internal image data corresponding to the final frame immediately before the switching from the first display mode to the second display mode to a writing start time point of the image data corresponding to the initial frame immediately after the switching from the first display mode to the second display mode. The luminance adjuster may adjust the display luminance based on the internal image data corresponding to the final frame immediately before switching from the first display mode to the second display mode according to the blanking period calculated by the calculator.

The luminance adjuster may include a conversion circuit that converts a grayscale of the internal image data such that the display luminance based on the internal image data corresponding to the final frame immediately before switching from the first display mode to the second display mode is higher than the display luminance based on the internal image data corresponding to another frame. The conversion circuit may convert the grayscale of the internal image data into a higher grayscale as the blanking period calculated by the calculator is lengthened.

The luminance adjuster may include a first conversion circuit that converts the grayscale of the internal image data corresponding to a frame except for the final frame in the first display mode and a second conversion circuit that converts the grayscale of the internal image data corresponding to the final frame in the first display mode. The second conversion circuit may convert the grayscale into a grayscale higher than the grayscale converted by the first conversion circuit.

The luminance adjuster may switch between the first conversion circuit and the second conversion circuit in a vertical blanking period.

In another general aspect, a display device includes a processor that performs processing on each frame of image data that includes plural frames, the display device displaying an image on a display screen based on the image data processed by the processor, the processor receiving the image data, a first control signal indicating a command to stop output of the image data, and a second control signal indicating a command to perform the output of the image data, a memory in which the image data received immediately before stop of transmission of the image data is stored as internal image data; and a luminance adjuster that adjusts a display luminance based on the received image data. The processor includes a first display mode in which the processor displays the image on the display screen from the internal image data after the processor receives the first control signal; and a second display mode in which the processor displays the image on the display screen from the image data received by the processor after the processor receives the second control signal. The luminance adjuster adjusts a display luminance based on the image data corresponding to an initial frame immediately after switching from the first display mode to the second display mode to a display luminance lower than a target display luminance. In the initial frame immediately after switching from the first display mode to the second display mode, the image is displayed on the display screen based on the image data in which the display luminance is adjusted by the luminance adjuster.

The above another general aspect may include one or more of the following features. The luminance adjuster may adjust the display luminance of the image data corresponding to the initial frame immediately after switching from the first display mode to the second display mode and the image data corresponding to at least one frame subsequent to the initial frame to the display luminance lower than the target display luminance, respectively, and adjusts the display luminance of a plurality of pieces of the image data such that the display luminance come close to the target display luminance in a stepwise manner.

The display device may further include a calculator that calculates a blanking period from a writing end time point of the internal image data corresponding to a final frame immediately before the switching from the first display mode to the second display mode to a writing start time point of the image data corresponding to the initial frame immediately after the switching from the first display mode to the second display mode. The luminance adjuster may adjust the display luminance based on the image data corresponding to the initial frame immediately after switching from the first display mode to the second display mode according to the blanking period calculated by the calculator.

The luminance adjuster may include a conversion circuit that converts a grayscale of the image data such that the display luminance based on the image data corresponding to the initial frame immediately after switching from the first display mode to the second display mode is lower than a target display luminance. The conversion circuit may convert the grayscale of the image data into a lower grayscale as the blanking period calculated by the calculator is lengthened.

The luminance adjuster may include a first conversion circuit that converts the grayscale of the image data corresponding to a frame except for the initial frame in the second display mode and a second conversion circuit that converts the grayscale of the image data corresponding to the initial frame in the second display mode. The second conversion circuit may convert the grayscale into a grayscale lower than the grayscale converted by the first conversion circuit.

The luminance adjuster may switch between the first conversion circuit and the second conversion circuit in a vertical blanking period.

In another general aspect, a method for driving a display device including a processor that performs processing on each frame of image data that includes plural frames, the display device displaying an image on a display screen based on the image data processed by the processor. The method includes receiving, with the processor, the image data, a first control signal indicating a command to stop output of the image data, and a second control signal indicating a command to perform the output of the image data, storing as internal image data in a memory the image data received immediately before stop of transmission of the image data, and adjusting with a luminance adjuster a display luminance based on the internal image data transferred from the memory. The processor includes a first display mode in which the processor displays the image on the display screen from the internal image data after the processor receives the first control signal and a second display mode in which the processor displays the image on the display screen from the image data received by the processor after the processor receives the second control signal. The luminance adjuster adjusts a display luminance based on the internal image data corresponding to a final frame immediately before switching from the first display mode to the second display mode to a display luminance higher than a display luminance of the internal image data of another frame in the first display mode. In the final frame immediately before switching from the first display mode to the second display mode, the image is displayed on the display screen based on the internal image data in which the display luminance is adjusted by the luminance adjuster.

In the display device of the present disclosure and driving method thereof, the display luminance difference can be reduced when the PSR mode is switched to the normal mode. Therefore, the display quality can be improved in the display device to which the PSR function is applied.

BRIEF DESCRIPTION OF DRAWINGS

FIG. 7 is a table of a second conversion circuit;

FIG. 8 is a table of a third conversion circuit;

DETAILED DESCRIPTION

Hereinafter, an exemplary embodiment of the present disclosure will be described with reference to the drawings. A liquid crystal display device is described below by way of example. However, a display device according to the present disclosure is not limited to the liquid crystal display device, but may be an organic electroluminescence display device and the like.

Figure 1:
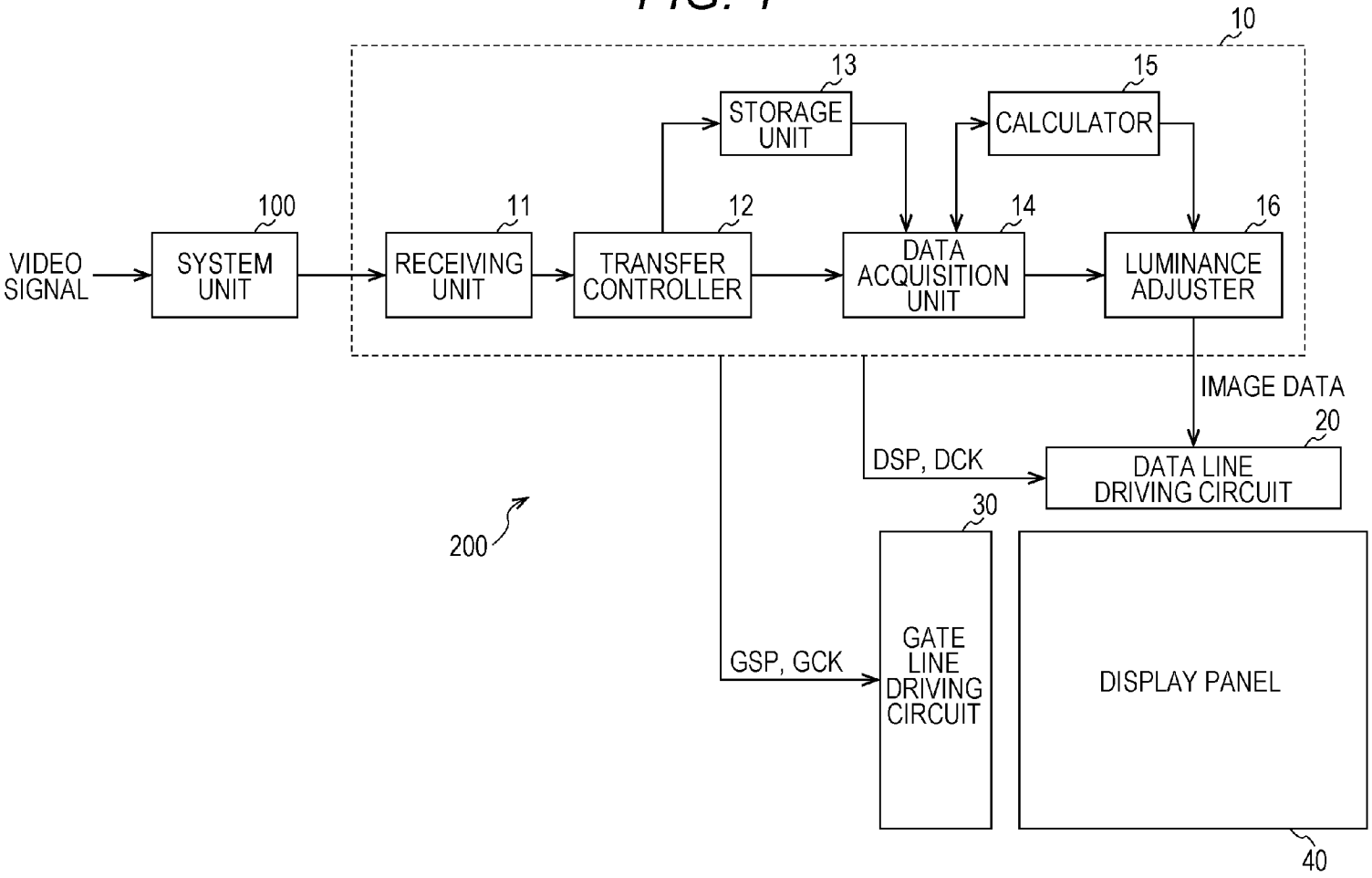
FIG. 1 is a view illustrating a schematic configuration of a display system according to an exemplary embodiment of the present disclosure.

FIG. 1 is a view illustrating a schematic configuration of a display system according to an exemplary embodiment of the present disclosure. The display system includes a system unit 100 and a liquid crystal display device 200. Based on a video signal supplied from an external signal source (host), the system unit 100 determines whether an image indicated by the image data is a moving image or a still image in each frame. The system unit 100 controls operation of the system unit 100 based on a determination result. The liquid crystal display device 200 performs processing of displaying the image on a display screen of a display panel 40 based on the image data supplied from the system unit 100. Specific configurations of the system unit 100 and liquid crystal display device 200 will be described below.

Figure 2:
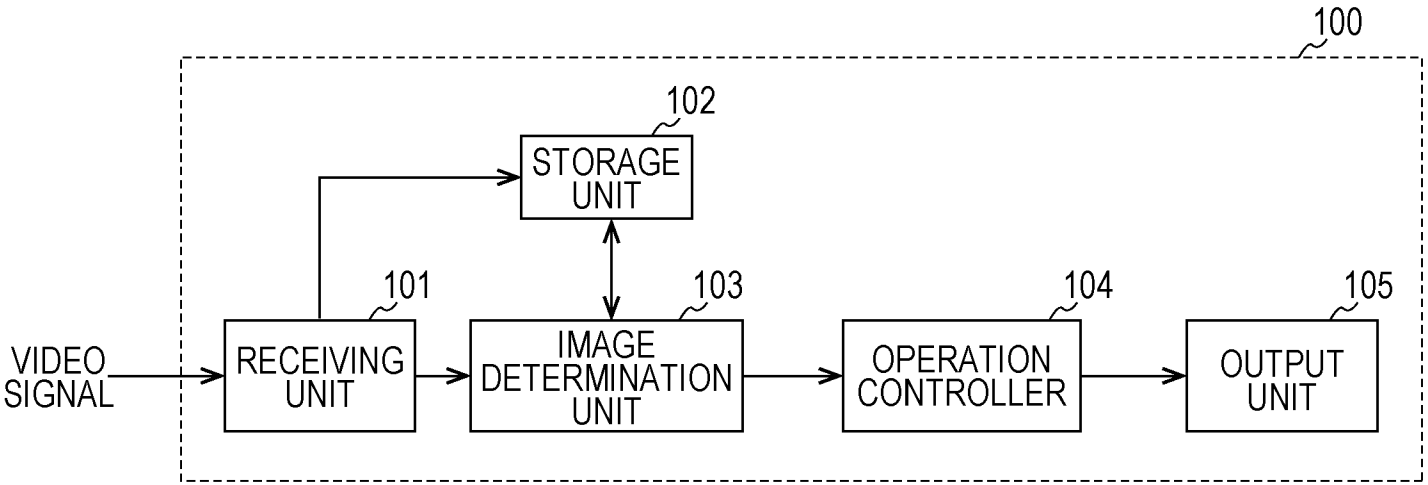
FIG. 2 is a block diagram illustrating a specific configuration of a system unit.

FIG. 2 is a block diagram illustrating a specific configuration of the system unit 100. The system unit 100 includes a receiving unit 101, a storage unit 102, an image determination unit 103, an operation controller 104, and an output unit 105.

The receiving unit 101 receives a video signal output from the host. The receiving unit 101 transfers the received video signal to the storage unit 102 and the image determination unit 103 in each frame. Hereinafter, the video signal in one frame unit is referred to as frame image data (also referred to as image data).

The frame image data transferred from the receiving unit 101 is temporarily stored in the storage unit 102. For example, the storage unit 102 is configured as a frame memory.

The image determination unit 103 determines whether an image (frame image) indicated by the frame image data transferred from the receiving unit 101 is a moving image or a still image. Specifically, the image determination unit 103 determines whether a frame image of a current frame is a moving image or a still image based on the frame image data of the current frame transferred from the receiving unit 101 and the frame image data of a last frame or pieces of frame image data of a plurality of precedent frames, the frame image data and the pieces of frame image data being stored in the storage unit 102. For example, the image determination unit 103 detects a difference between the frame image data of the current frame and the frame image data of the last frame, determines that the current frame image is a moving image when the detected difference is larger than or equal to a threshold, and determines that the current frame image is a still image when the detected difference is less than the threshold. There is no limitation to the moving image and still image determination method, but any known method can be used. The image determination unit 103 transfers the frame image data of the current frame acquired from the receiving unit 101 to the operation controller 104 together with the determination result.

The operation controller 104 controls the operation of the system unit 100 based on the frame image data and the determination result, which are acquired from the image determination unit 103. Specifically, when the frame image is a moving image, the operation controller 104 causes the output unit 105 to output the frame image data. On the other hand, when the frame image is a still image, the operation controller 104 stops the frame image data output operation of the output unit 105.

Hereinafter, a case that the system unit 100 outputs the frame image data (moving image) is referred to as a normal mode, and a case that the system unit 100 does not output the frame image data (still image) is referred to as a PSR mode (low power consumption mode).

In a case where the frame image is switched from a moving image to a still image, the operation controller 104 transfers the frame image data corresponding to the still image to the output unit 105 while a control signal for putting the PSR mode into an on state, namely, a first control signal PSR_ON indicating a command to stop the output of the frame image data is provided to the frame image data.

In a case where the frame image is switched from a still image to a moving image, the operation controller 104 transfers the frame image data corresponding to the moving image to the output unit 105 while a control signal for putting the PSR mode into an off state (normal mode), namely, a second control signal PSR_OFF indicating a command to execute the output of the frame image data is provided to the frame image data.

After the frame image is switched from a still image to a moving image, the operation controller 104 transfers only the frame image data to the output unit 105 while the frame image data indicating a moving image is input to the system unit 100 (normal mode period).

The operation controller 104 is not limited to the above configuration. For example, the operation controller 104 may provide a flag (for example, flag "0") indicating a moving image or a flag (for example, flag "1") indicating a still image to each piece of frame image data based on the determination result. Specifically, the operation controller 104 may generate a packet including the flag and the frame image data, and sequentially output the generated packet from the output unit 105.

The output unit 105 outputs the frame image data, the frame image data to which the first control signal PSR_ON is provided, and the frame image data to which the second control signal PSR_OFF is provided, all the pieces of frame image data being acquired from the operation controller 104, to the liquid crystal display device 200.

In the PSR mode period, the operation controller 104 may stop the operation to transfer the frame image data to the output unit 105, or the operation controller 104 may stop the frame image data output operation of the output unit 105. Because the video signal is continuously input in the PSR mode period, the determination processing of the image determination unit 103 and the control processing of the operation controller 104 are continued.

In the above configuration of the system unit 100, the image data output operation of the system unit 100 is stopped while the host supplies the video signal (image data) corresponding to the still image. Therefore, the power consumption of the system unit 100 can be reduced.

The system unit 100 outputs various timing signals (such as a vertically synchronous signal, a horizontally synchronous signal, and a clock signal) to the liquid crystal display device 200.

The specific configuration of the liquid crystal display device 200 will be described with reference to FIG. 1. The liquid crystal display device 200 includes an image processing controller 10, a data line driving circuit 20, a gate line driving circuit 30, and the display panel 40.

The image processing controller 10 adjusts the display luminance of the frame image indicated by the frame image data supplied from the system unit 100 based on a characteristic (moving image or still image) of the frame image. The display luminance means apparent brightness when the frame image is displayed on the display screen of the display panel 40.

Based on various timing signals supplied from the system unit 100, the image processing controller (hardware processor) 10 generates various control signals (such as a data start pulse DSP, a data clock DCK, a gate start pulse GSP, and a gate clock GCK) in order to control the operations of the data line driving circuit 20 and gate line driving circuit 30. The image processing controller 10 outputs the generated data start pulse DSP and data clock DCK to the data line driving circuit 20. The image processing controller 10 outputs the generated gate start pulse GSP and gate clock GCK to the gate line driving circuit 30. Because a known configuration can be used as the configuration generating each of the control signals, the configuration generating each of the control signals is omitted in FIG. 1.

Figure 3:
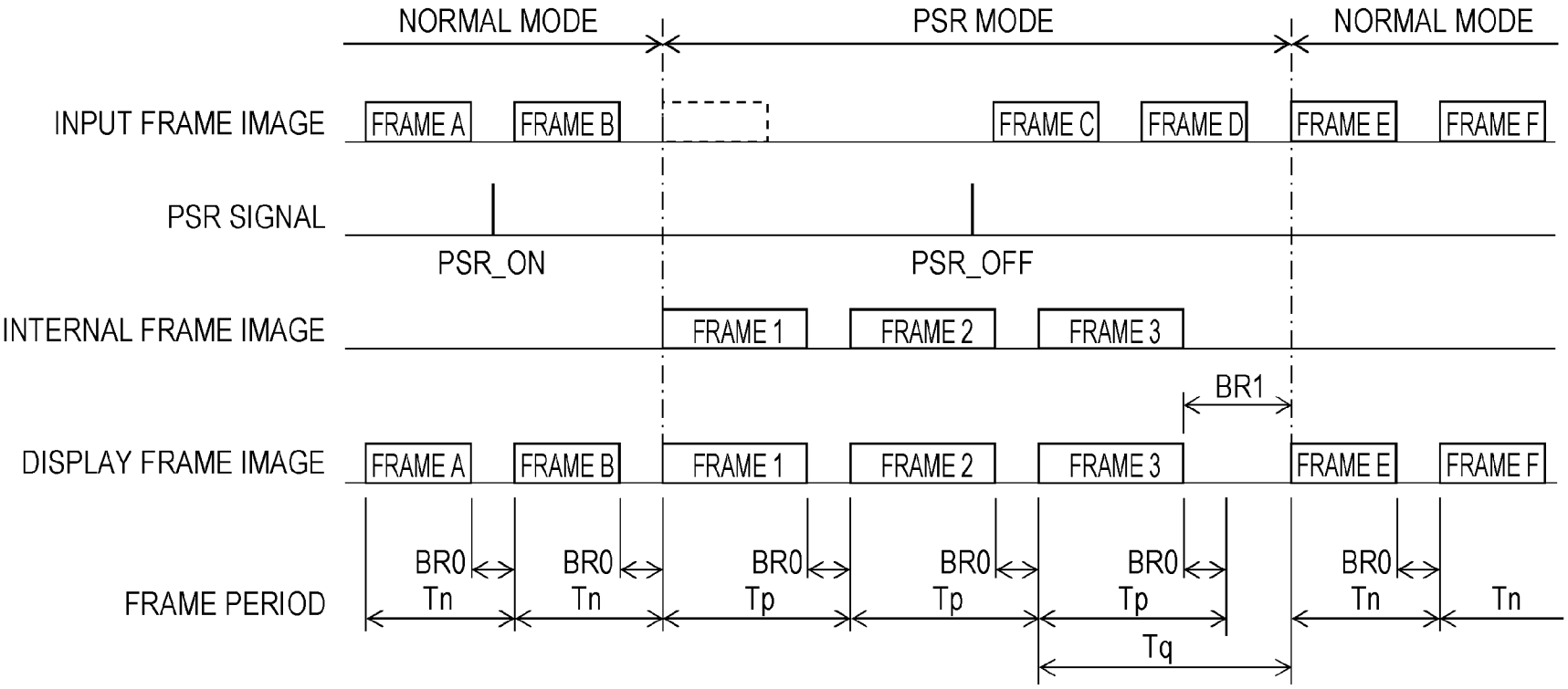
FIG. 3 illustrates an example of various pieces of data input to and output from an image processing controller in time series.

The image processing controller 10 includes a receiving unit 11, a transfer controller 12, a storage unit (hardware memory) 13, a data acquisition unit 14, a calculator 15, and a luminance adjuster 16. FIG. 3 illustrates an example of various pieces of data input to and output from the image processing controller 10 in time series.

The image processing controller 10 receives, via the receiving unit 11, the frame image data, the frame image data to which the first control signal PSR_ON is provided, and the frame image data to which the second control signal PSR_OFF is provided, all the pieces of frame image data being output from the system unit 100. In FIG. 3, the input frame image indicates the frame image data received by the receiving unit 11, and the PSR signal indicates the first control signal PSR_ON and second control signal PSR_OFF, which are provided to the frame image data. In the example of FIG. 3, the first control signal PSR_ON is provided to the image data of a frame B, and the second control signal PSR_OFF is provided to the image data of a frame C. The receiving unit 11 transfers the received frame image data to the transfer controller 12.

When the frame image indicated by the frame image data acquired from the receiving unit 11 is a still image, the transfer controller 12 transfers the frame image data to the storage unit 13 and the data acquisition unit 14. On the other hand, when the frame image indicated by the frame image data acquired from the receiving unit 11 is a moving image, the transfer controller 12 transfers the frame image data to the data acquisition unit 14.

Specifically, in a case where the first control signal PSR_ON is provided to the frame image data acquired from the receiving unit 11, the transfer controller 12 transfers the frame image data to the storage unit 13 and the data acquisition unit 14. On the other hand, in a case where the second control signal PSR_OFF is provided to the frame image data acquired from the receiving unit 11, the transfer controller 12 transfers the frame image data to the data acquisition unit 14. The transfer controller 12 transfers the frame image data acquired from the receiving unit 11 to the data acquisition unit 14 until the frame image data to which the first control signal PSR_ON is provided is input to the image processing controller 10 since the frame image data to which the second control signal PSR_OFF is provided is input to the image processing controller 10. In the configuration in which the flag ("0" or "1") is provided to the frame image data, the transfer controller 12 performs frame image data transfer processing based on the flag.

In the example of FIG. 3, the transfer controller 12 transfers the image data of the frame B indicating a still image to the storage unit 13 and the data acquisition unit 14, and transfers the image data of each of frames A, C, D, E, and F indicating a moving image to the data acquisition unit 14.

The frame image data, which is transferred from the transfer controller 12 and indicates a still image, is stored in the storage unit 13. For example, the storage unit 13 is configured as a frame memory. The pieces of image data of the frames 1, 2, and 3 in FIG. 3 correspond to the image data (internal image data) of the frame B stored in the storage unit 13.

According to predetermined timing, the data acquisition unit 14 acquires the frame image data transferred from the transfer controller 12 or the frame image data stored in the storage unit 13. The data acquisition unit 14 outputs the acquired frame image data to the luminance adjuster 16.

In the example of FIG. 3, in the normal mode, the data acquisition unit 14 acquires the image data of the frame A when the image data of the frame A is transferred from the transfer controller 12 in the predetermined timing, and the data acquisition unit 14 acquires the image data of the frame B when the image data of the frame B is transferred from the transfer controller 12 in the predetermined timing. In the PSR mode, data acquisition unit 14 acquires the image data of the frame B stored in the storage unit 13 in timing corresponding to a predetermined drive frequency (frame frequency). For example, in the PSR mode, the data acquisition unit 14 acquires the image data in the timing corresponding to the low drive frequency (for example, 48 Hz) rather than the drive frequency (for example, 60 Hz) in the normal mode. Therefore, in the PSR mode, the low frequency drive can be performed to yield the lower power consumption of the liquid crystal display device 200. For example, the drive frequency is set by adjusting a clock frequency.

In the PSR mode of FIG. 3, in a case where the image processing controller 10 receives the second control signal PSR_OFF before the end of the operation to display the image data (corresponding to the still image) of the frame 2, the data acquisition unit 14 acquires not the image data (corresponding to the moving image) of the frame C, but the image data (corresponding to the still image) of the frame B (corresponding to the frame 3) stored in the storage unit 13. That is, after the second control signal PSR_OFF is received, the data acquisition unit 14 acquires the image data for one frame (in this case, the frame 3) corresponding to the still image from the storage unit 13.

In the PSR mode, in a case where the transfer controller 12 transfers the image data (corresponding to the moving image) of the frame D before the end of an original frame period Tp of the image data of the frame 3, the data acquisition unit 14 acquires not the image data of the frame D, but the image data (corresponding to the moving image) of the frame E transferred next from the transfer controller 12.

Thus, the data acquisition unit 14 acquires the image data from the transfer controller 12 or the storage unit 13 based on the timing to receive the second control signal PSR_OFF and the timing to start and end the image data frame period. A display mode, in which the data acquisition unit 14 acquires the frame image data indicating a moving image and the display operation is performed based on the frame image data, corresponds to the normal mode (second display mode). In FIG. 3, the period including the frames A and B and the period including the frames E and F become the normal mode. On the other hand, a display mode, in which the data acquisition unit 14 acquires the frame image data indicating a still image and the display operation is performed based on the frame image data, corresponds to the PSR mode (first display mode). In FIG. 3, the period including the frames 1 to 3 becomes the PSR mode.

The calculator 15 calculates a vertical retrace period (blanking period) in the frame image data indicating a still image at the time immediately before the display mode is switched from the PSR mode to the normal mode. Specifically, the calculator 15 calculates the period (blanking period) from a writing end time point of the frame image data (corresponding to the still image), which is acquired by the data acquisition unit 14 and stored in the storage unit 13 after the receiving unit 11 receives the second control signal PSR_OFF, to a writing start time point of the frame image data (corresponding to the moving image) that is acquired next from the transfer controller 12 by the data acquisition unit 14.

In the example of FIG. 3, the calculator 15 calculates a blanking period BR1 from a writing end time point of the image data of the frame 3, the image data being acquired by the data acquisition unit 14 after the receiving unit 11 receives the second control signal PSR_OFF, to a writing start time point of the image data of the frame E, the image data being acquired next from the transfer controller 12 by the data acquisition unit 14. The calculator 15 outputs the calculated blanking period BR1 to the luminance adjuster 16. When the second control signal PSR_OFF is received, the calculator 15 can calculate the blanking period BR1 based on a reception position of the second control signal PSR_OFF relative to the frame period Tp of the frame image data (corresponding to the frame 3) indicating a still image.

Figure 19:
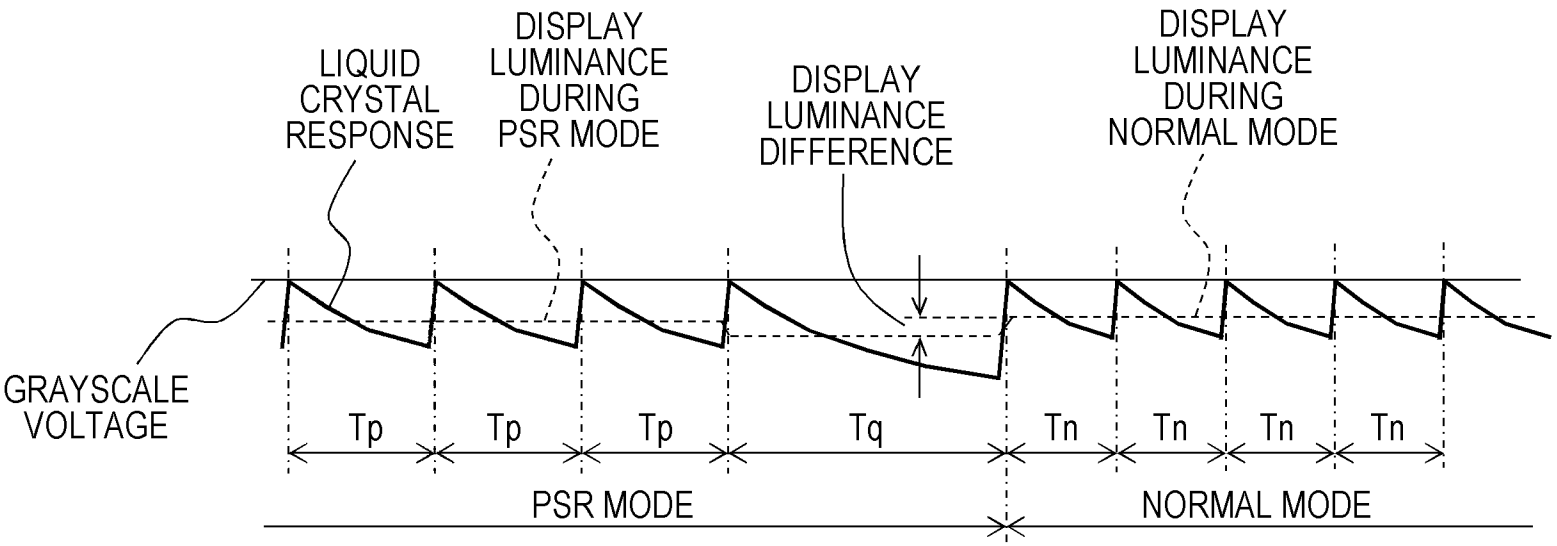
FIG. 19 is a graph illustrating a change in display luminance on a display screen of a conventional liquid crystal display device.

At this point, desirably the blanking periods in the frames are equal to each other. This is because, in a case where the blanking periods in the frames are not equal to each other, a liquid crystal response characteristic fluctuates, and the flicker is generated in the display image due to the display luminance difference (refer to FIG. 19). However, for the liquid crystal display device to which the PSR function is applied, because the low frequency drive is performed in the PSR mode, as illustrated in FIG. 3, sometimes the blanking period BR1 is lengthened in order to match the timing to start the display of the moving image in switching the display mode from the PSR mode to the normal mode (BR1>BR0). When the blanking period BR1 becomes longer, as illustrated in FIG. 19, the display luminance is lowered, and a flicker is generated due to the display luminance difference. For example, in FIG. 3, as the blanking period BR1 is lengthened, a difference (BR1-BR0) with the blanking period BR0 in another frame increases, and the display luminance difference increases. Thus, the display luminance decreasing amount and the display luminance difference are correlated with the length of the blanking period.

The luminance adjuster 16 performs processing of reducing the display luminance difference. Specifically, the luminance adjuster 16 acquires the frame image data (corresponding to the still image) stored in the storage unit 13 from the data acquisition unit 14, and acquires a calculation result of the blanking period BR1 from the calculator 15. According to the acquired length of the blanking period BR1, the luminance adjuster 16 adjusts the display luminance of the frame image indicated by the acquired frame image data. The luminance adjuster 16 acquires the frame image data corresponding to the moving image from the transfer controller 12, and adjusts the display luminance of the frame image corresponding to the acquired frame image data.

Figure 4:
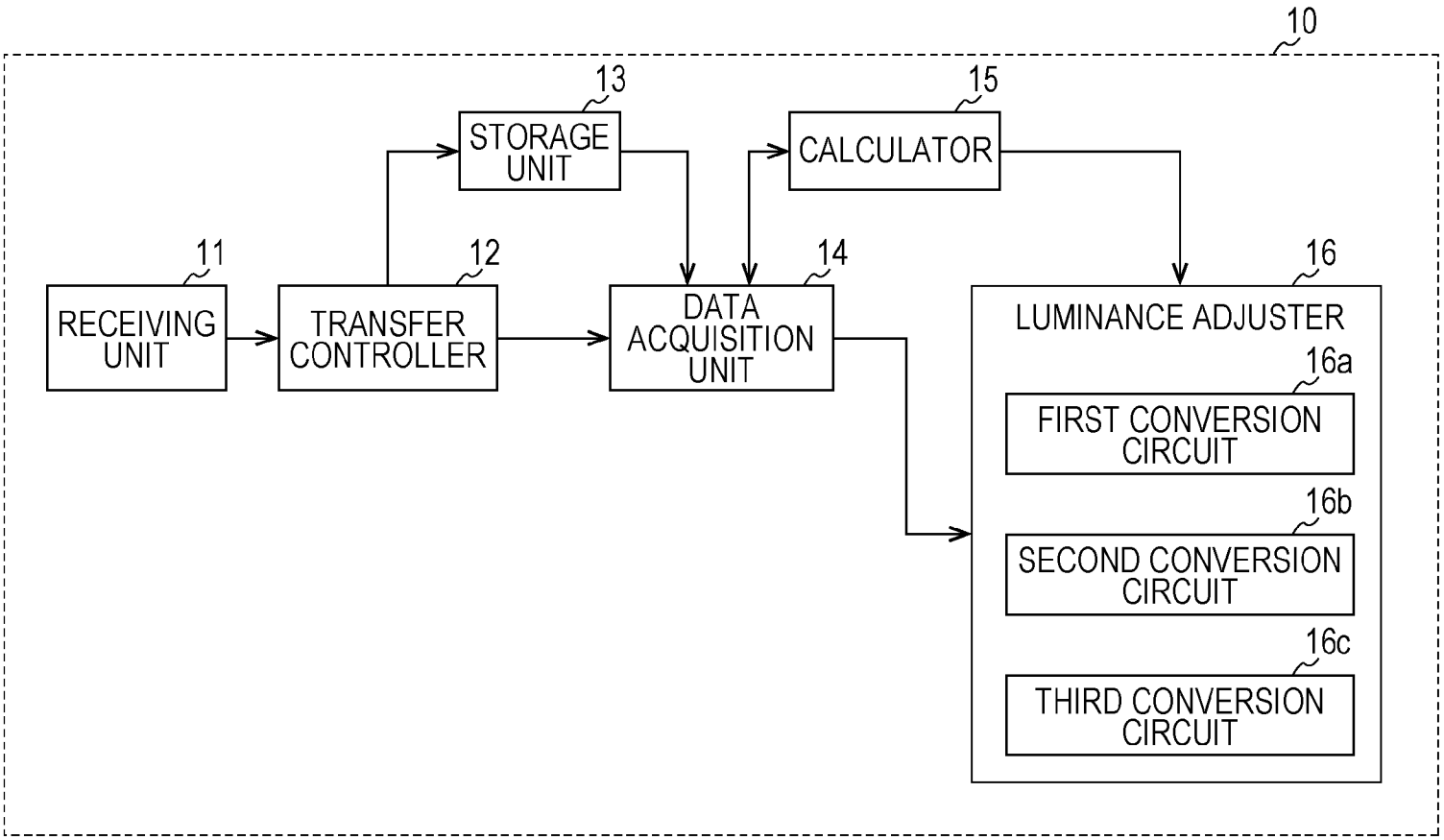
FIG. 4 is a block diagram illustrating a specific configuration of the image processing controller.

As illustrated in FIG. 4, the luminance adjuster 16 includes a first conversion circuit 16*a* and a second conversion circuit 16*b*. The first conversion circuit 16*a* converts a grayscale (input grayscale) of the frame image data (digital data) input to the luminance adjuster 16 into a predetermined grayscale. The second conversion circuit 16*b* converts the grayscale of the input frame image data into a grayscale higher than the predetermined grayscale.

A known configuration can be applied to the first conversion circuit 16*a*. For example, the first conversion circuit 16*a* converts the grayscale (input grayscale) of the input frame image data into the grayscale (predetermined grayscale) corresponding to a display characteristic (for example, a gamma characteristic) of the display panel 40. A curve (a) in FIG. 5 is a graph illustrating a relationship between the input grayscale and the output grayscale into which the input grayscale is converted in the first conversion circuit 16*a*.

Figures 5, 6:
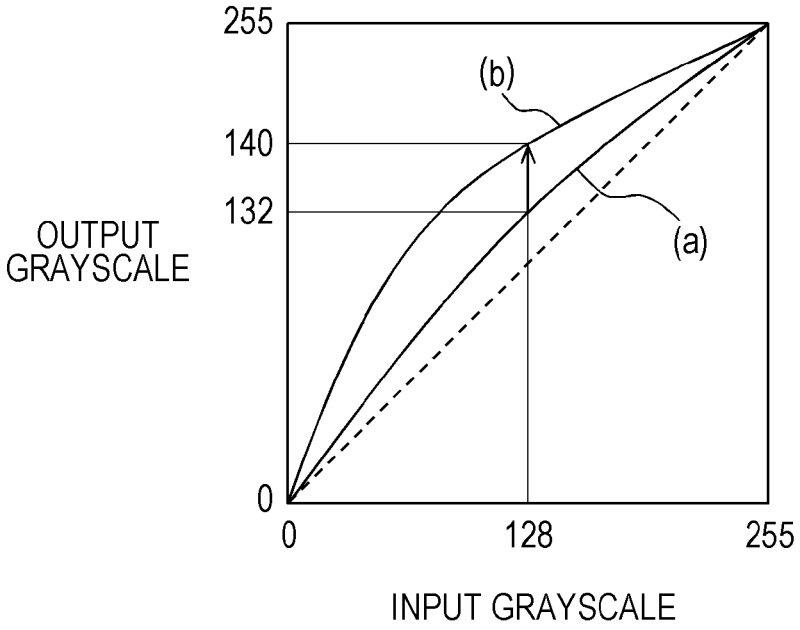
FIG. 5 is a graph illustrating a relationship between the input grayscale and the output grayscale into which the input grayscale is converted in the conversion circuit.
FIG. 6 is a table of a first conversion circuit.

For example, the first conversion circuit 16*a* is configured with a table (look-up table) in FIG. 6. In the table of FIG. 6, the input grayscale and output grayscale of the frame image data are correlated with each other with respect to the curve (a) in FIG. 5. The input grayscale and the output grayscale are partially illustrated in FIG. 6. The first conversion circuit 16*a* may be configured not to convert the input grayscale. In this case, the relationship between the input grayscale and the output grayscale is illustrated by a dotted line (straight line) in the graph of FIG. 5.

The second conversion circuit 16*b* converts the grayscale (input grayscale) of the input frame image data into the grayscale higher than the predetermined grayscale so as to reduce the display luminance difference (refer to FIG. 19). A curve (b) in FIG. 5 is a graph illustrating a relationship between the input grayscale and the output grayscale into which the input grayscale is converted in the second conversion circuit 16*b*. As illustrated by the curve (b) in FIG. 5, the output grayscale of the second conversion circuit 16*b* is set higher than the output grayscale (curve (a)) of the first conversion circuit 16*a*. The output grayscale of the second conversion circuit 16*b* is set according to the length of the blanking period BR1. The relationship between the input grayscale and the output grayscale in the second conversion circuit 16*b* is not limited to the curve (b) in FIG. 5. For example, the output grayscale may be kept constant (for example, a 255-level grayscale) in a predetermined range (for example, at least a 240-level grayscale) where the input grayscale is located on a high grayscale side.

For example, the second conversion circuit 16*b* is configured with a table in FIG. 7. In the table of FIG. 7, the input grayscale and output grayscale of the frame image data are correlated with each other with respect to the curve (b) in FIG. 5. FIG. 7 illustrates parts of the input grayscale and output grayscale.

Specifically, in each frame of the normal mode and the frame except for the final frame (the frame immediately before the switching from the PSR mode to the normal mode) of the PSR mode, the luminance adjuster 16 converts the grayscale of the frame image data using the first conversion circuit 16*a*. On the other hand, in the final frame of the PSR mode, the luminance adjuster 16 converts the grayscale of the frame image data using the second conversion circuit 16*b* in a case where the blanking period BR1 is longer than a predetermined period (for example, the blanking period BR0 in FIG. 3), and the luminance adjuster 16 converts the grayscale of the frame image data using the first conversion circuit 16*a* in a case where the blanking period BR1 is shorter than or equal to the predetermined period. In the example of FIG. 3, the luminance adjuster 16 converts the grayscale of the image data of each of the frames A, B, 1, 2, E, and F using the first conversion circuit 16*a*, and converts the grayscale of the image data of the frame 3 using the second conversion circuit 16*b*.

The luminance adjuster 16 may further include a third conversion circuit 16*c* (refer to FIG. 4) that converts the grayscale of the image data into a grayscale higher than the grayscale converted by the second conversion circuit 16*b*. In this case, in the final frame of the PSR mode, the luminance adjuster 16 selects the second conversion circuit 16*b* or the third conversion circuit 16*c* according to the blanking period BR1, and converts the grayscale of the frame image data based on the selected conversion circuit. For example, the luminance adjuster 16 selects the second conversion circuit 16*b* in a case where the blanking period BR1 is located in a range of t1 (=BR0)<BR1<t2, and selects the third conversion circuit 16*c* in a case where the blanking period BR1 is located in a range of t2<BR1. FIG. 8 illustrates an example of a table constituting the third conversion circuit 16*c*.

There is no limitation to the number of conversion circuits provided in the luminance adjuster 16. The luminance adjuster 16 switches the conversion circuit in the vertical retrace period (blanking period). The luminance adjuster 16 may be provided outside the image processing controller 10, or inside the data line driving circuit 20. The conversion circuit is not limited to the configuration in which the grayscale is converted using the table. For example, the conversion circuit may include a calculation circuit, and the output grayscale may be calculated based on the input grayscale and the blanking period In the configuration of the luminance adjuster 16, the grayscale of the image data (corresponding to the still image) of the frame (the final frame in the PSR mode) immediately before the switching from the PSR mode to the normal mode is converted into the grayscale higher than the grayscale of the image data (corresponding to the still image) of another frame in the PSR mode.

The luminance adjuster 16 outputs the frame image data (digital data) in which the grayscale is converted by each conversion circuit to the data line driving circuit 20.

The data line driving circuit 20 supplies a grayscale voltage to a plurality of data lines DL based on the data start pulse DSP and data clock DCK output from the image processing controller 10 and the frame image data (digital data) output from the luminance adjuster 16. Because a known configuration can be applied to the configuration of the data line driving circuit 20, the description is omitted.

The gate line driving circuit 30 sequentially supplies a gate signal to a plurality of gate lines GL based on the gate start pulse GSP and gate clock GCK output from the image processing controller 10. Because a known configuration can be applied to the configuration of the gate line driving circuit 30, the description is omitted.

Figure 9:
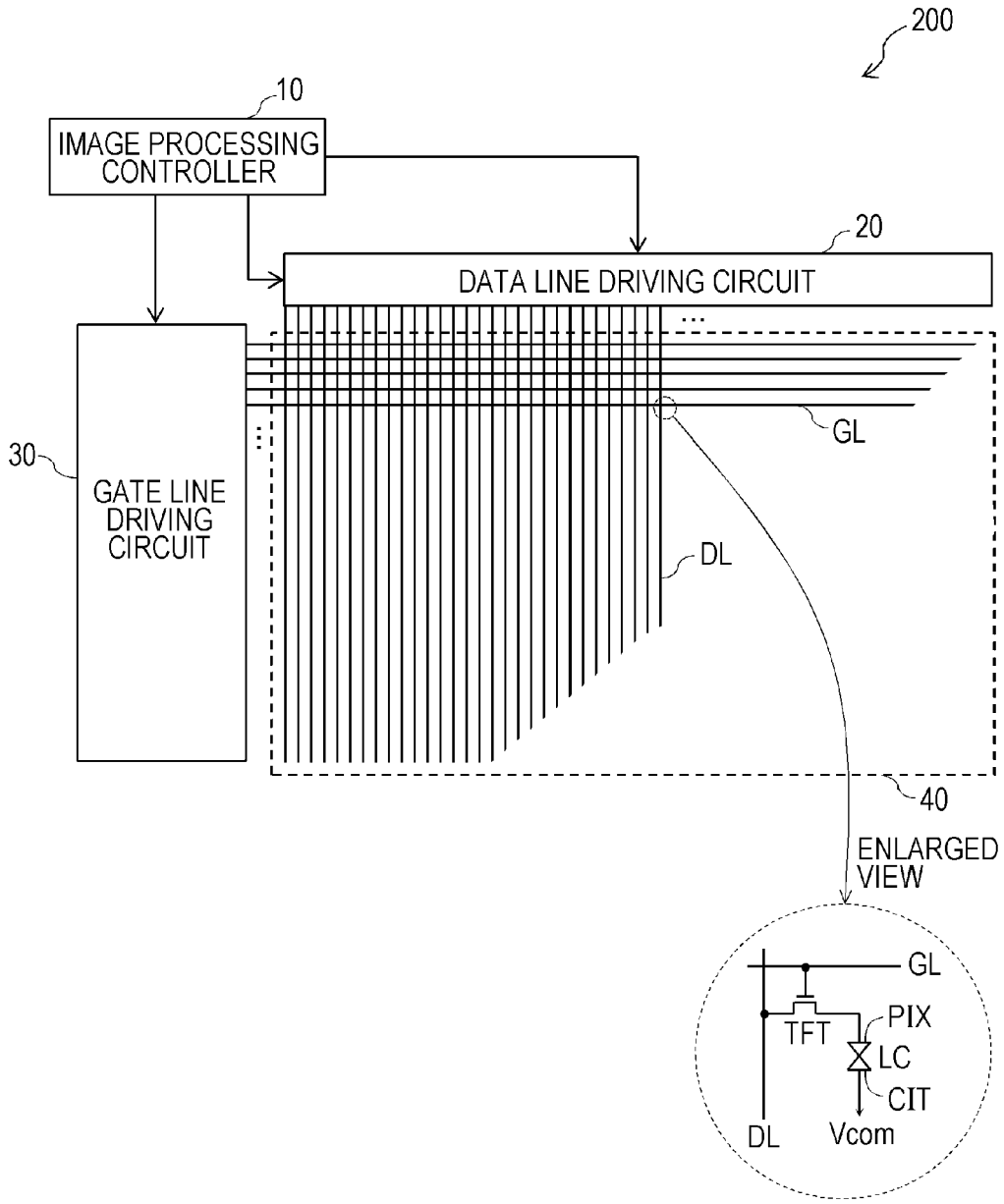
FIG. 9 is a plan view illustrating a specific configuration of a display panel.

FIG. 9 is a plan view illustrating a specific configuration of the display panel 40. The display panel 40 includes a Thin Film Transistor substrate (TFT substrate) (not illustrated), a Color Filter substrate (CF substrate) (not illustrated), and a liquid crystal layer LC that is sandwiched between both the substrates. The plurality of data lines DL connected to the data line driving circuit 20 and the plurality of gate lines GL connected to the gate line driving circuit 30 are provided in the TFT substrate, and a thin film transistor TFT is provided in each intersection portion of the data line DL and gate line GL. In the display panel 40, a plurality of pixels are arranged into a matrix shape (a row direction and a column direction) according to the intersection portions. The display panel 40 also includes a pixel electrode PIX and a common electrode CIT according to each pixel. The display panel 40 puts the thin film transistor TFT into the on state using the gate signal supplied to the gate line GL, and displays the image on the display screen according to the grayscale voltage applied to the pixel electrode PIX through the data line DL. The data line driving circuit 20 and the gate line driving circuit 30 may be formed on the TFT substrate. The display panel 40 is not limited to the above configuration, but a known configuration can be applied to the display panel 40.

Figure 10:
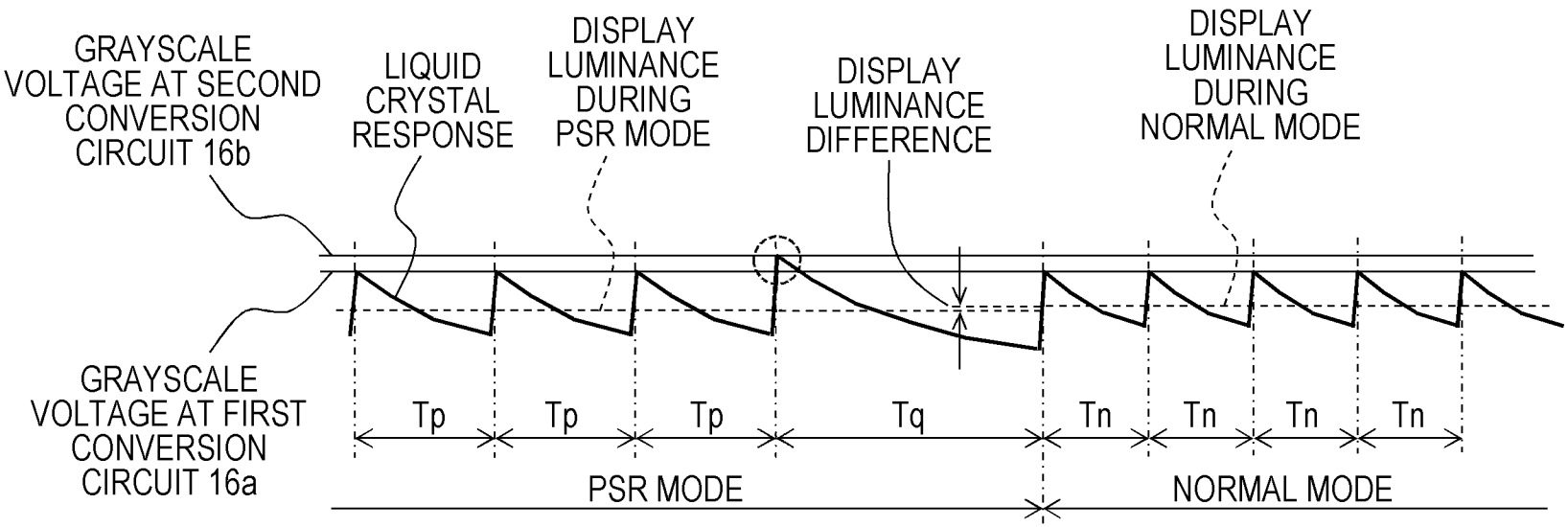
FIG. 10 is a graph illustrating a change in display luminance on the display screen of the liquid crystal display device of the exemplary embodiment.

FIG. 10 is a graph illustrating a change in display luminance on the display screen of the liquid crystal display device 200 of the exemplary embodiment. FIG. 10 schematically illustrates a change in liquid crystal response and the display luminance in a case where the image having the same grayscale is displayed in the normal mode and the PSR mode. In FIG. 10, a dotted line illustrates the apparent display luminance (average luminance in each frame).

In the liquid crystal display device 200, the grayscale of the image data of the frame (the final frame in the PSR mode) immediately before the switching from the PSR mode to the normal mode is set higher than the grayscale of the image data of another frame in the PSR mode (refer to a portion surrounded by a dotted line in FIG. 10). Therefore, as illustrated in FIG. 10, the display luminance of the frame image (still image) in the final frame (frame period Tq) is approximated to the display luminance of the frame image (still image) in another frame (frame period Tp). Therefore, compared with the conventional configuration (refer to FIG.

19), the change in display luminance (display luminance difference) decreases in the frame (the frame E in FIG. 3) immediately after the switching from the PSR mode to the normal mode. Therefore, the flicker caused by the display luminance difference can be reduced compared with the conventional configuration.

[First Modification]

The liquid crystal display device 200 of the present disclosure is not limited to the above configuration. For example, the liquid crystal display device 200 may convert the grayscale of the image data of the frame (the initial frame in the normal mode) immediately after the switching from the PSR mode to the normal mode into the grayscale lower than the input grayscale of the image data. A configuration of a liquid crystal display device 200 according to a first modification will be described below mainly a difference from the above configuration.

Figure 11:
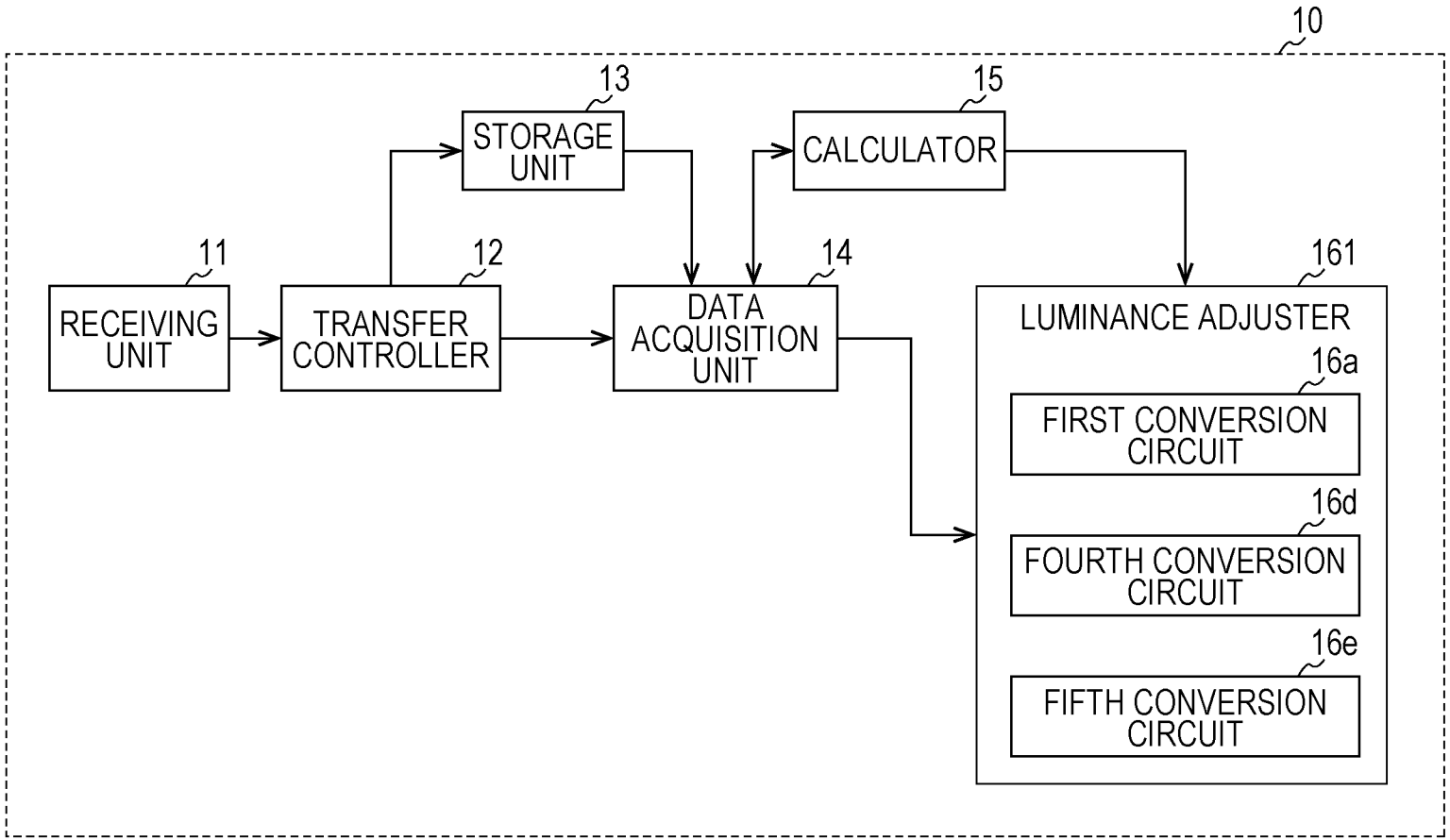
FIG. 11 is a block diagram illustrating a specific configuration of an image processing controller of a first modification.

As illustrated in FIG. 11, a luminance adjuster 161 of the first modification includes the first conversion circuit 16*a* that converts the grayscale (input grayscale) of the input frame image data (digital data) into the predetermined grayscale and a fourth conversion circuit 16*d* that converts the grayscale of the input frame image data such that the display luminance of the frame image becomes lower than a target display luminance.

Figures 12, 13:
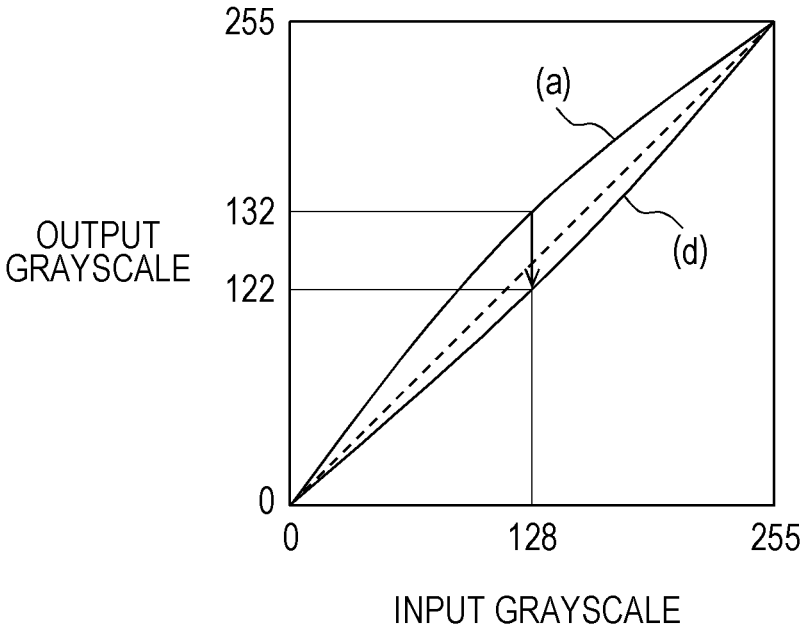
FIG. 12 is a graph illustrating a relationship between the input grayscale and the output grayscale into which the input grayscale is converted in the conversion circuit of the first modification.
FIG. 13 is a table of a second conversion circuit of the first modification.

The fourth conversion circuit 16*d* converts the grayscale (input grayscale) of the input frame image data so as to reduce the display luminance difference (refer to FIG. 19). A curve (a) in FIG. 12 is a graph illustrating the relationship between the input grayscale and the output grayscale into which the input grayscale is converted in the first conversion circuit 16*a*. The output grayscale of the first conversion circuit 16*a* is set to the grayscale corresponding to the target display luminance. A curve (d) in FIG. 12 is a graph illustrating the relationship between the input grayscale and the output grayscale into which the input grayscale is converted in the fourth conversion circuit 16*d*. As illustrated by the curve (d) in FIG. 12, the output grayscale of the fourth conversion circuit 16*d* is set lower than the output grayscale (curve (a)) of the first conversion circuit 16*a*. The output grayscale of the fourth conversion circuit 16*d* is set according to the length of the blanking period BR1.

For example, the fourth conversion circuit 16*d* is configured with a table in FIG. 13. In the table of FIG. 13, the input grayscale and output grayscale of the frame image data are correlated with each other with respect to the curve (d) in FIG. 12. The input grayscale and the output grayscale are partially illustrated in FIG. 13.

Specifically, in each frame of the PSR mode and the frame except for the initial frame (the frame immediately after the switching from the PSR mode to the normal mode) of the normal mode, the luminance adjuster 161 converts the grayscale of the frame image data using the first conversion circuit 16*a*. On the other hand, in the initial frame of the normal mode, the luminance adjuster 161 converts the grayscale of the frame image data using the fourth conversion circuit 16*d* in a case where the blanking period BR1 acquired from the calculator 15 is longer than a predetermined period (for example, the blanking period BR0 in FIG. 3), and the luminance adjuster 161 converts the grayscale of the frame image data using the first conversion circuit 16*a* in a case where the blanking period BR1 is shorter than or equal to the predetermined period. In the example of FIG. 3, the luminance adjuster 161 converts the grayscale of the image data of each of the frames A, B, 1, 2, 3, and F using the first conversion circuit 16*a*, and converts the grayscale of the image data of the frame E using the fourth conversion circuit 16*d*. The luminance adjuster 161 may further include a fifth conversion circuit 16*e* (refer to FIG. 11) that converts the grayscale of the image data into a grayscale lower than the grayscale converted by the fourth conversion circuit 16*d*.

Figure 14:
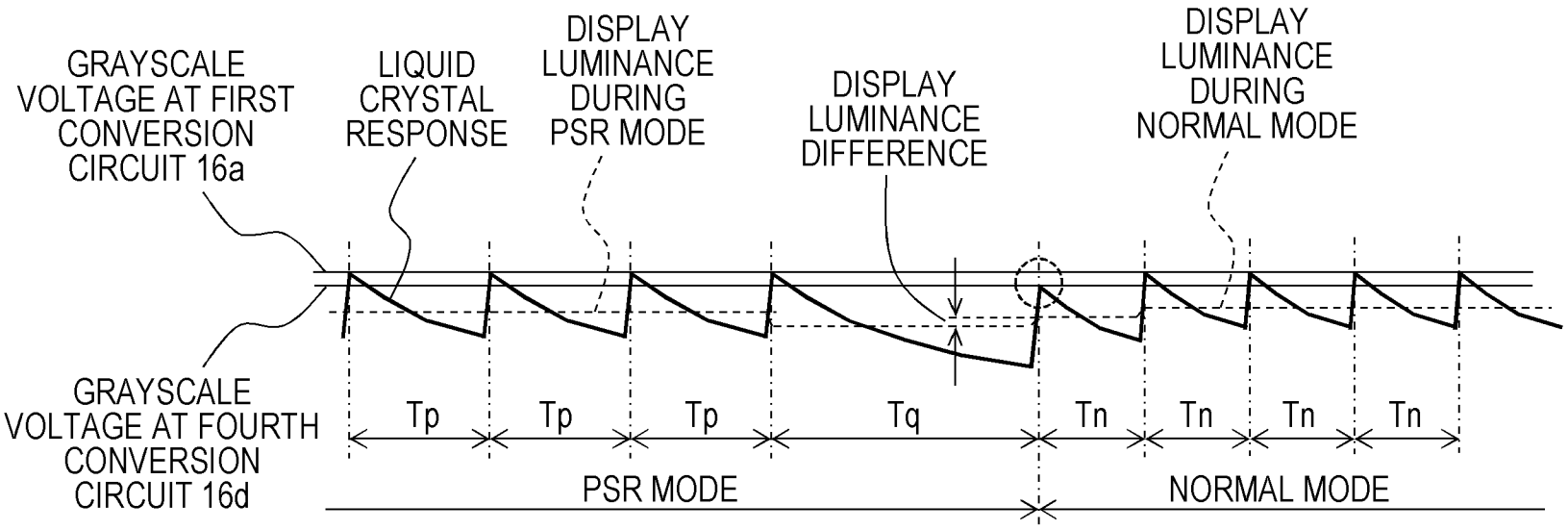
FIG. 14 is a graph illustrating a change in display luminance on a display screen of a liquid crystal display device of the first modification.

FIG. 14 is a graph illustrating a change in display luminance on the display screen of the liquid crystal display device 200 of the first modification. FIG. 14 schematically illustrates a change in liquid crystal response and the display luminance in a case where the image having the same grayscale is displayed in the normal mode and the PSR mode.

In the liquid crystal display device 200 of the first modification, the grayscale of the image data of the frame (the initial frame in the normal mode) immediately after the switching from the PSR mode to the normal mode is set lower than the grayscale corresponding to the target display luminance (refer to a portion surrounded by a dotted line in FIG. 14). Therefore, as illustrated in FIG. 14, the display luminance of the frame image (moving image) in the initial frame (frame period Tn) of the normal mode comes close to the display luminance of the frame image (still image) of the last frame (frame period Tq). Therefore, compared with the conventional configuration (refer to FIG. 19), the change in display luminance (display luminance difference) decreases in the frame (the frame E in FIG. 3) immediately after the switching from the PSR mode to the normal mode. Therefore, the flicker caused by the display luminance difference can be reduced compared with the conventional configuration.

Using the fourth conversion circuit 16*d*, the luminance adjuster 161 of the first modification performs the grayscale conversion only on the initial frame (the frame immediately after the switching from the PSR mode to the normal mode) in the normal mode. However, the luminance adjuster 161 is not limited to the configuration in FIG. 11. For example, the luminance adjuster 161 may include a fifth conversion circuit 16*e* (refer to FIG. 11) in which the output grayscale is set to the grayscale between the output grayscale set by the first conversion circuit 16*a* and the output grayscale set by the fourth conversion circuit 16*d*. In this case, the luminance adjuster 161 converts the grayscale of the frame image data using the fourth conversion circuit 16*d* with respect to the initial frame (the frame E in FIG. 3) in the normal mode, and converts the grayscale of the frame image data using the fifth conversion circuit 16*e* with respect to the next frame (the frame F in FIG. 3).

Figure 15:
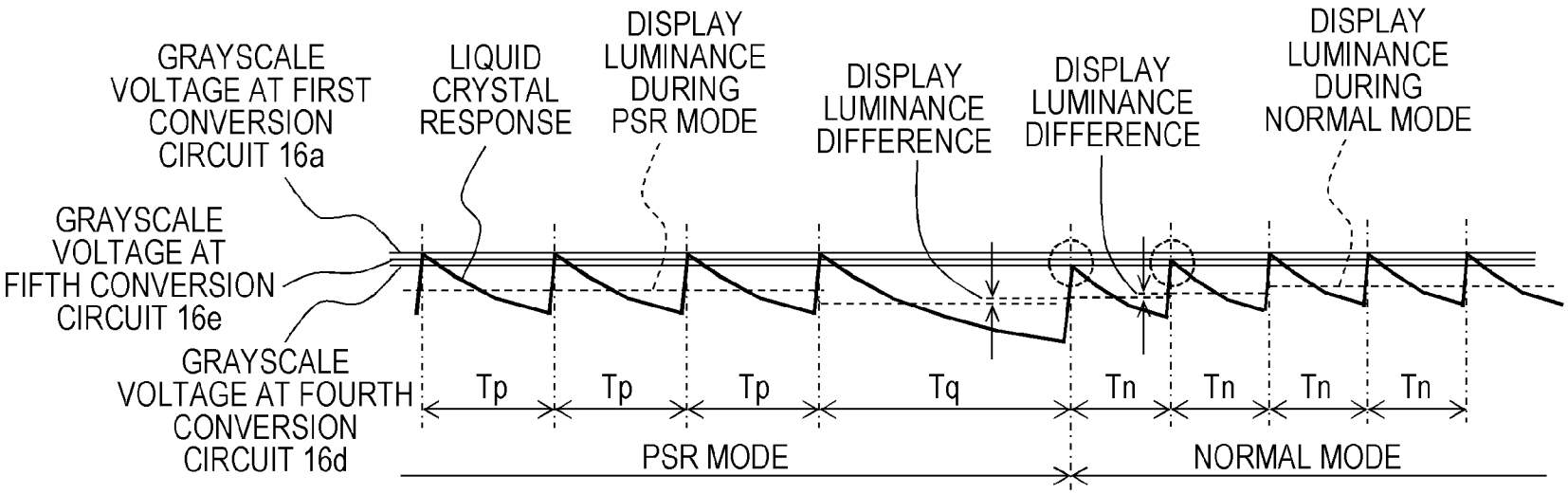
FIG. 15 is a graph illustrating a change in display luminance on the display screen of the liquid crystal display device of the first modification.

As illustrated in FIG. 15, after a transition to the normal mode, the display luminance of each frame image increases so as to come close to the target display luminance in a stepwise manner. Therefore, because the display luminance difference between the frames can be decreased stepwise, the flicker caused by the display luminance difference can be reduced.

[Second Modification]

As illustrated in FIG. 3, the data acquisition unit 14 acquires the image data (corresponding to the still image) of the frame 3 stored in the storage unit 13 after acquiring the image data (corresponding to the still image) of the frame 2. However, the data acquisition unit 14 is not limited to the configuration in FIG. 3. For example, the data acquisition unit 14 may acquire the image data (corresponding to the moving image) of the frame D transferred from the transfer controller 12 after the end of the frame period (the frame period Tp of the frame 2 in FIG. 3) including the time point at which the receiving unit 11 receives the second control signal PSR_OFF.

Figure 16:
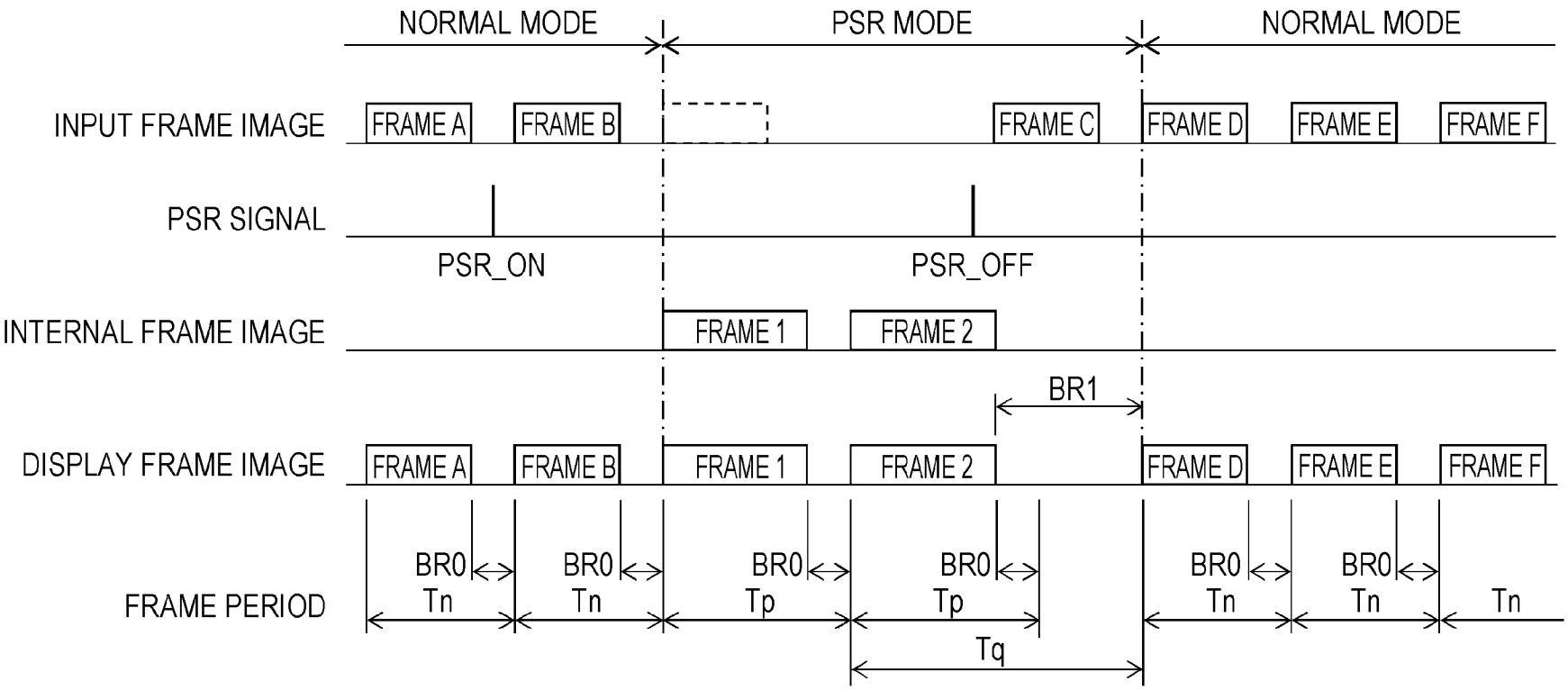
FIG. 16 illustrates an example of various pieces of data input to and output from an image processing controller of a second modification in time series.

FIG. 16 illustrates an example of various pieces of data input to and output from an image processing controller 10 according to a second modification in time series. In the example of FIG. 16, the image data of the frame D is switched to the normal mode. In this case, as illustrated in the first modification, the luminance adjuster 16 converts the grayscale of the image data of the frame (the frame D in FIG. 16) immediately after the switching from the PSR mode to the normal mode into the grayscale lower than the grayscale corresponding to the target display luminance.

[Third Modification]

The second control signal PSR_OFF is input from the system unit 100 to the image processing controller 10 at arbitrary timing. For example, the second control signal PSR_OFF is output from the system unit 100 in a case where the video signal of the moving image is input from the host to the system unit 100, or that an event is input from the host (PC) to the system unit 100 by a user. In the period of the PSR mode, the second control signal PSR_OFF is received at arbitrary timing. As illustrated in FIG. 16, as the timing to receive the second control signal PSR_OFF comes close to an end side of the frame period (in this case, the frame period Tp of the frame 2), the blanking period BR1 is lengthened to increase the display luminance decreasing amount.

Figure 17:
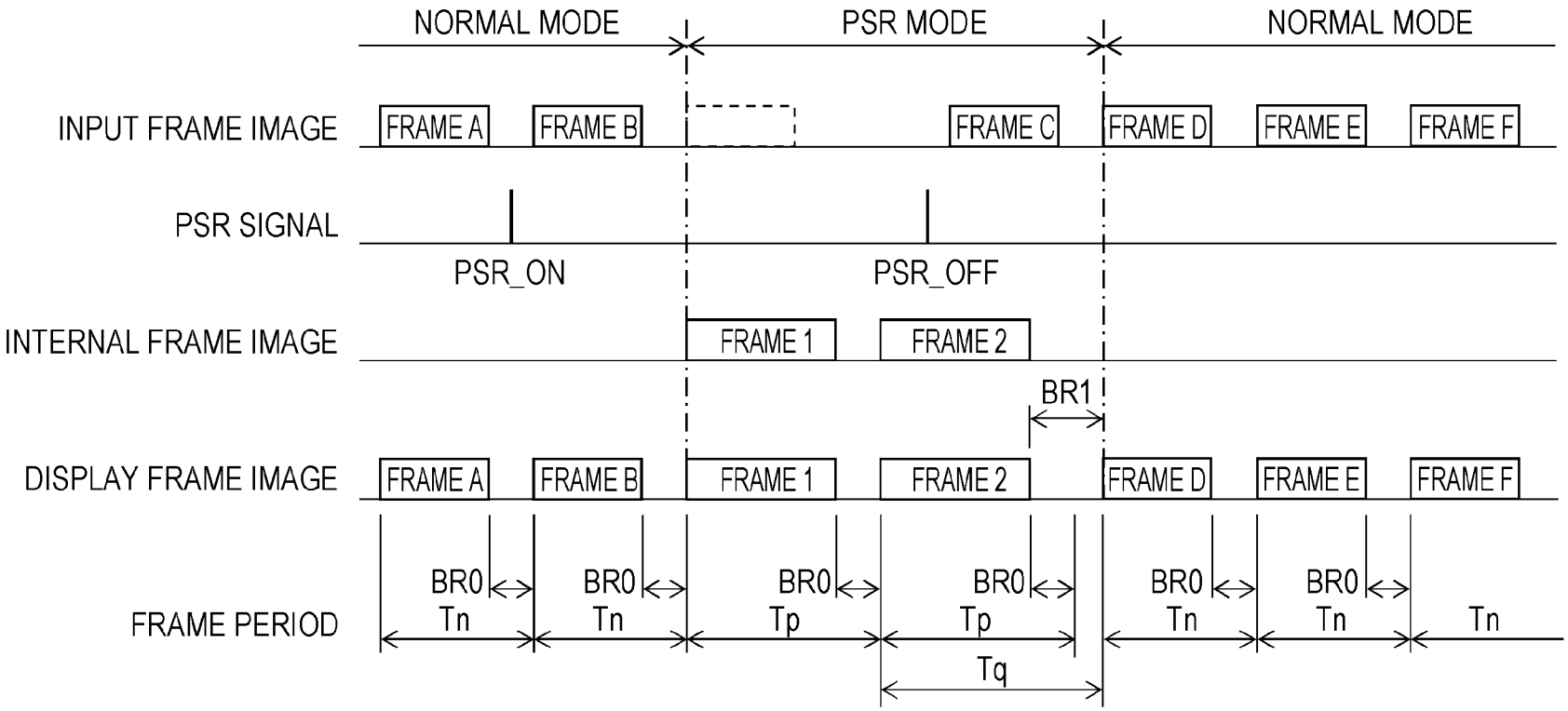
FIG. 17 illustrates another example of various pieces of data input to and output from the image processing controller of the second modification in time series.

Therefore, the data acquisition unit 14 may determine the frame image data to be acquired according to the timing to receive the second control signal PSR_OFF. For example, the frame image data (corresponding to the still image) stored in the storage unit 13 is acquired in a case where the timing to receive the second control signal PSR_OFF is later than a predetermined timing (for example, a midpoint) in the frame period. In the example of FIG. 3, the image data of the frame 3 is acquired. On the other hand, the frame image data transferred from the transfer controller 12 is acquired in a case where the timing to receive the second control signal PSR_OFF is earlier than the predetermined timing (for example, the midpoint) in the frame period as illustrated in FIG. 17. In the example of FIG. 17, the image data (corresponding to the moving image) of the frame D is acquired.

Figure 18:
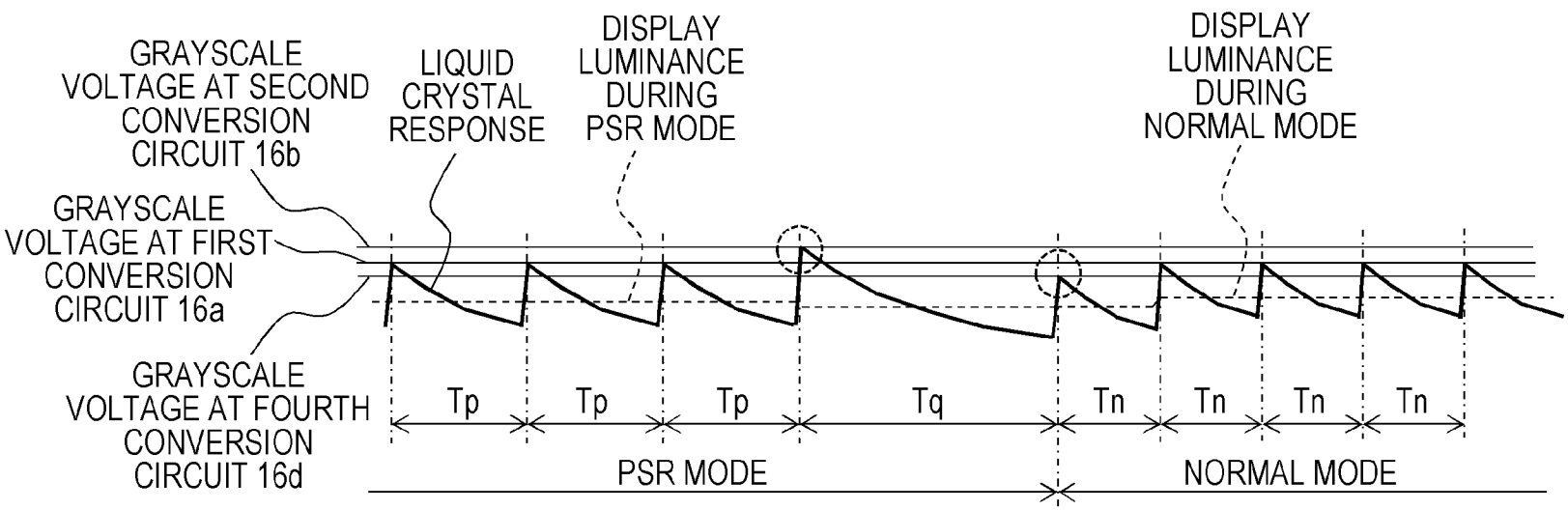
FIG. 18 is a graph illustrating a change in display luminance on a display screen of a liquid crystal display device of a their modification.

Therefore, in a case where the frame image data (corresponding to the frame 3 in FIG. 3) stored in the storage unit 13 is acquired after the second control signal PSR_OFF is received as illustrated in FIG. 3, the luminance adjuster 16 may convert the grayscale of the frame image data (corresponding to the frame 3 (still image) in FIG. 3) acquired by the data acquisition unit 14 using the second conversion circuit 16*b* (refer to FIG. 4) such that the display luminance is increased, and convert the grayscale of the frame image data (corresponding to the frame E (moving image) in FIG. 3) acquired by the data acquisition unit 14 using the fourth conversion circuit 16*d* (refer to FIG. 11) such that the display luminance is lower than the target display luminance. That is, in a liquid crystal display device 200 according to a third modification, the luminance adjuster 16 may include the first and second conversion circuits 16*a* and 16*b* in FIG. 4 and the fourth conversion circuit 16*d* in FIG. 11. Therefore, as illustrated in FIG. 18, the display luminance of the frame image can be adjusted before and after the switching from the PSR mode to the normal mode. Therefore, the display luminance difference of the frame image can be reduced before and after the switching from the PSR mode to the normal mode. The adjustment of the display luminance is not limited to the last and next frames, but the display luminance of the plurality of last and next frame images may be adjusted.

Although the exemplary embodiments of the present disclosure are described above, the display device of the present disclosure is not limited to the exemplary embodiments. It is noted that exemplary embodiments properly changed from the exemplary embodiments by those skilled in the art without departing from the scope of the present disclosure are included in the present disclosure.

What is claimed is:

1. A display device comprising:

a processor that performs processing on each frame of image data that includes plural frames, the display device displaying an image on a display screen based on the image data processed by the processor, wherein the processor receives the image data, a first control signal indicating a command to stop output of the image data, and a second control signal indicating a command to perform the output of the image data;

a memory in which the image data received immediately before stop of transmission of the image data is stored as internal image data; and a luminance adjuster that adjusts a display luminance based on the internal image data transferred from the memory, wherein the processor includes: a first display mode in which the processor displays the image on the display screen from the internal image data after the processor receives the first control signal; and a second display mode in which the processor displays the image on the display screen from the image data received by the processor after the processor receives the second control signal, wherein the luminance adjuster adjusts a display luminance based on the internal image data corresponding to a final frame immediately before switching from the first display mode to the second display mode to a display luminance higher than a display luminance of the internal image data of another frame in the first display mode, and in the final frame immediately before switching from the first display mode to the second display mode, the image is displayed on the display screen based on the internal image data in which the display luminance is adjusted by the luminance adjuster.

2. The display device according to claim 1, further comprising a calculator that calculates a blanking period from a writing end time point of the internal image data corresponding to the final frame immediately before the switching from the first display mode to the second display mode to a writing start time point of the image data corresponding to the initial frame immediately after the switching from the first display mode to the second display mode, wherein the luminance adjuster adjusts the display luminance based on the internal image data corresponding to the final frame immediately before switching from the first display mode to the second display mode according to the blanking period calculated by the calculator.

3. The display device according to claim 2, wherein the luminance adjuster includes a conversion circuit that converts a grayscale of the internal image data such that the display luminance based on the internal image data corresponding to the final frame immediately before switching from the first display mode to the second display mode is higher than the display luminance based on the internal image data corresponding to another frame, and the conversion circuit converts the grayscale of the internal image data into a higher grayscale as the blanking period calculated by the calculator is lengthened.

4. The display device according to claim 3, wherein the luminance adjuster includes a first conversion circuit that converts the grayscale of the internal image data corresponding to a frame except for the final frame in the first display mode and a second conversion circuit that converts the grayscale of the internal image data corresponding to the final frame in the first display mode, and the second conversion circuit converts the grayscale into a grayscale higher than the grayscale converted by the first conversion circuit.

5. The display device according to claim 4, wherein the luminance adjuster switches between the first conversion circuit and the second conversion circuit in a vertical blanking period.

6. A display device comprising:

a processor that performs processing on each frame of image data that includes plural frames, the display device displaying an image on a display screen based on the image data processed by the processor, wherein the processor receives the image data, a first control signal indicating a command to stop output of the image data, and a second control signal indicating a command to perform the output of the image data;

a memory in which the image data received immediately before stop of transmission of the image data is stored as internal image data; and a luminance adjuster that adjusts a display luminance based on the received image data, wherein the processor includes: a first display mode in which the processor displays the image on the display screen from the internal image data after the processor receives the first control signal; and a second display mode in which the processor displays the image on the display screen from the image data received by the processor after the processor receives the second control signal, wherein the luminance adjuster adjusts a display luminance based on the image data corresponding to an initial frame immediately after switching from the first display mode to the second display mode to a display luminance lower than a target display luminance, and in the initial frame immediately after switching from the first display mode to the second display mode, the image is displayed on the display screen based on the image data in which the display luminance is adjusted by the luminance adjuster.

7. The display device according to claim 6, wherein the luminance adjuster adjusts the display luminance of the image data corresponding to the initial frame immediately after switching from the first display mode to the second display mode and the image data corresponding to at least one frame subsequent to the initial frame to the display luminance lower than the target display luminance, respectively, and adjusts the display luminance of a plurality of pieces of the image data such that the display luminance come close to the target display luminance in a stepwise manner.

8. The display device according to claim 6, further comprising a calculator that calculates a blanking period from a writing end time point of the internal image data corresponding to a final frame immediately before the switching from the first display mode to the second display mode to a writing start time point of the image data corresponding to the initial frame immediately after the switching from the first display mode to the second display mode, wherein the luminance adjuster adjusts the display luminance based on the image data corresponding to the initial frame immediately after switching from the first display mode to the second display mode according to the blanking period calculated by the calculator.

9. The display device according to claim 8, wherein the luminance adjuster includes a conversion circuit that converts a grayscale of the image data such that the display luminance based on the image data corresponding to the initial frame immediately after switching from the first display mode to the second display mode is lower than a target display luminance, and the conversion circuit converts the grayscale of the image data into a lower grayscale as the blanking period calculated by the calculator is lengthened.

10. The display device according to claim 9, wherein the luminance adjuster includes a first conversion circuit that converts the grayscale of the image data corresponding to a frame except for the initial frame in the second display mode and a second conversion circuit that converts the grayscale of the image data corresponding to the initial frame in the second display mode, and the second conversion circuit converts the grayscale into a grayscale lower than the grayscale converted by the first conversion circuit.

11. The display device according to claim 10, wherein the luminance adjuster switches between the first conversion circuit and the second conversion circuit in a vertical blanking period.

12. A method for driving a display device including a processor that performs processing on each frame of image data that includes plural frames, the display device displaying an image on a display screen based on the image data processed by the processor, said method comprising:

receiving, with the processor, the image data, a first control signal indicating a command to stop output of the image data, and a second control signal indicating a command to perform the output of the image data;

storing as internal image data in a memory the image data received immediately before stop of transmission of the image data; and adjusting with a luminance adjuster a display luminance based on the internal image data transferred from the memory, wherein the processor includes: a first display mode in which the processor displays the image on the display screen from the internal image data after the processor receives the first control signal; and a second display mode in which the processor displays the image on the display screen from the image data received by the processor after the processor receives the second control signal, wherein the luminance adjuster adjusts a display luminance based on the internal image data corresponding to a final frame immediately before switching from the first display mode to the second display mode to a display luminance higher than a display luminance of the internal image data of another frame in the first display mode, and in the final frame immediately before switching from the first display mode to the second display mode, the image is displayed on the display screen based on the internal image data in which the display luminance is adjusted by the luminance adjuster.

* * * * *